United States Patent [19]

Hunter

[11] 4,286,443

[45] Sep. 1, 1981

[54] ASSURED SLOW SPEED SPIN FOR FABRIC WASHING MACHINE

[75] Inventor: William H. Hunter, Newton, Iowa

[73] Assignee: The Maytag Company, Newton, Iowa

[21] Appl. No.: 135,473

[22] Filed: Mar. 31, 1980

[51] Int. Cl.[3] ..... D06F 33/02

[52] U.S. Cl. ..... 68/12 R

[58] Field of Search ..... 68/12 R

[56] References Cited

U.S. PATENT DOCUMENTS

| | | | |
|---|---|---|---|
| 3,140,595 | 7/1964 | Low | 68/12 R |
| 3,474,646 | 10/1969 | Sims et al. | 68/12 R |
| 3,550,171 | 12/1970 | Anthony et al. | 68/12 R X |
| 3,648,487 | 3/1972 | Hoffman | 68/12 R |

*Primary Examiner*—Philip R. Coe

*Attorney, Agent, or Firm*—Richard L. Ward

[57] ABSTRACT

An automatic fabric washing machine is selectively operable through a plurality of cycles for washing either permanent press or regular fabrics. The drive system is selectively operable in either low or high speed for agitation of the fabric load or to spin the fabric basket for extraction of liquid from the fabric load. Circuitry is provided for bypassing the selected drive speed to assure that the initial cool-down spin increment for the permanent press cycle will always be at a low speed to reduce the quantity of liquid pumped from the machine and to allow the fabrics to cool down with potentially reduced wrinkling. After the assured slow speed initial spin increment, the machine will proceed through the remainder of the cycle at the operator selected speeds.

6 Claims, 3 Drawing Figures

| TIMER CAM CHART | 90 SECOND INTERVALS | | | | | | | | | | | | | | | | | | | |
|---|---|---|---|---|---|---|---|---|---|---|---|---|---|---|---|---|---|---|---|---|
| SW \ INT. | | | | | 5 | | | | | | 10 | | | | | 15 | | | | |
| 44 | | | | | | | | | | | | | | ■ | ■ | | □ | ■ | ■ | ■ |
| 45 | ■ | ■ | ■ | ■ | ■ | ■ | ■ | ■ | ■ | ■ | ■ | ■ | ■ | ■ | ■ | ■ | ■ | ■ | ■ | □ |
| 46 | □ | ■ | ■ | ■ | ■ | ■ | ■ | ■ | ■ | □ | □ | □ | □ | □ | □ | □ | □ | □ | □ | ■ |
| 47 | □ | □ | ■ | ■ | ■ | ■ | ■ | ■ | ■ | □ | □ | □ | □ | □ | □ | □ | □ | □ | □ | □ |
| 48 | □ | □ | □ | □ | □ | □ | □ | □ | □ | ■ | ■ | □ | □ | □ | ■ | ■ | □ | □ | □ | □ |
| 58 | □ | □ | ■ | ■ | ■ | ■ | ■ | ■ | ■ | □ | □ | ■ | □ | □ | □ | ■ | □ | □ | □ | □ |
| 59 | □ | □ | □ | □ | □ | □ | □ | □ | □ | □ | □ | □ | ■ | ■ | □ | □ | ■ | ■ | ■ | □ |
| 60 | □ | □ | ■ | ■ | ■ | ■ | ■ | ■ | ■ | □ | □ | ■ | □ | □ | □ | ■ | □ | □ | □ | □ |
| 61 | □ | □ | □ | □ | □ | □ | □ | □ | □ | ■ | □ | □ | ■ | ■ | □ | □ | ■ | ■ | ■ | □ |
| 62 | □ | □ | ■ | ■ | ■ | ■ | ■ | ■ | ■ | □ | □ | ■ | □ | □ | □ | ■ | □ | □ | □ | □ |
| 63 | □ | □ | □ | □ | □ | □ | □ | □ | □ | ■ | □ | □ | ■ | ■ | □ | □ | ■ | ■ | ■ | □ |
| 64 | □ | □ | □ | □ | □ | □ | □ | □ | □ | ■ | □ | □ | □ | □ | □ | □ | □ | □ | □ | □ |

ASSURED SLOW SPEED SPIN FOR FABRIC WASHING MACHINE

BACKGROUND OF THE INVENTION

This invention relates generally to the field of automatic fabric washing machines and more particularly to providing a machine cycle having circuitry for overriding preselected speeds of operation to assure a slow speed initial spin operation.

In the field of automatic fabric washing machines it is known industry practice to allow the operator to select the speed of agitation and spin independently of the cycle selection. Thus, the speeds selected by the operator dictate the speeds utilized for agitation and for spin even though these speeds may be incorrect for a particular cycle of operations.

At least one manufacturer provides for only a cycle selection with no opportunity for speed selection by the operator to avoid a problem. The particular cycle is preprogrammed into the timer mechanism and no further operator input is necessary or permitted.

None of the known previous fabric washing machines provide for speed selection by the operator separately from a particular cycle selection while providing bypass circuitry to assure a slow speed spin during the initial portion of the permanent press cycle, for example.

SUMMARY OF THE INVENTION

It is therefore an object of the instant invention to provide an improved washing cycle in an automatic fabric washing machine.

It is a further object of the instant invention to provide for separate selection of cycle and speed of operation in a washing machine and to provide for at least partially overriding the operator's selection.

It is a still further object of the instant invention to provide circuitry for bypassing an operator-preselected spin speed and to assure a slow speed spin during the initial part of the permanent press cycle of operations.

Briefly, the instant invention achieves these objects in a control system for a fabric washing apparatus operable through a plurality of cycles. The apparatus includes an agitator within a rotatable fabric-receiving basket and drive mechanism selectively operable for driving each of the agitator and basket at a first relatively low speed and a second relatively high speed. A sequential controller controls the apparatus through a predetermined sequence of events defining the plurality of cycles. Cycle selection apparatus is provided for selecting a particular one of the plurality of cycles. A speed selection device is operable independently of the cycle selection apparatus and includes a switch for effecting one of the speeds of the drive mechanism. Circuitry associated with the sequential controller and the drive mechanism is actuated during a predetermined portion of the particular one cycle to provide a bypass circuit relative to the switch for overriding the speed selection device and operating the drive mechanism in the other of the speeds during the predetermined portion of the particular one cycle and permitting operation at the selected speed for the balance of the cycle.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
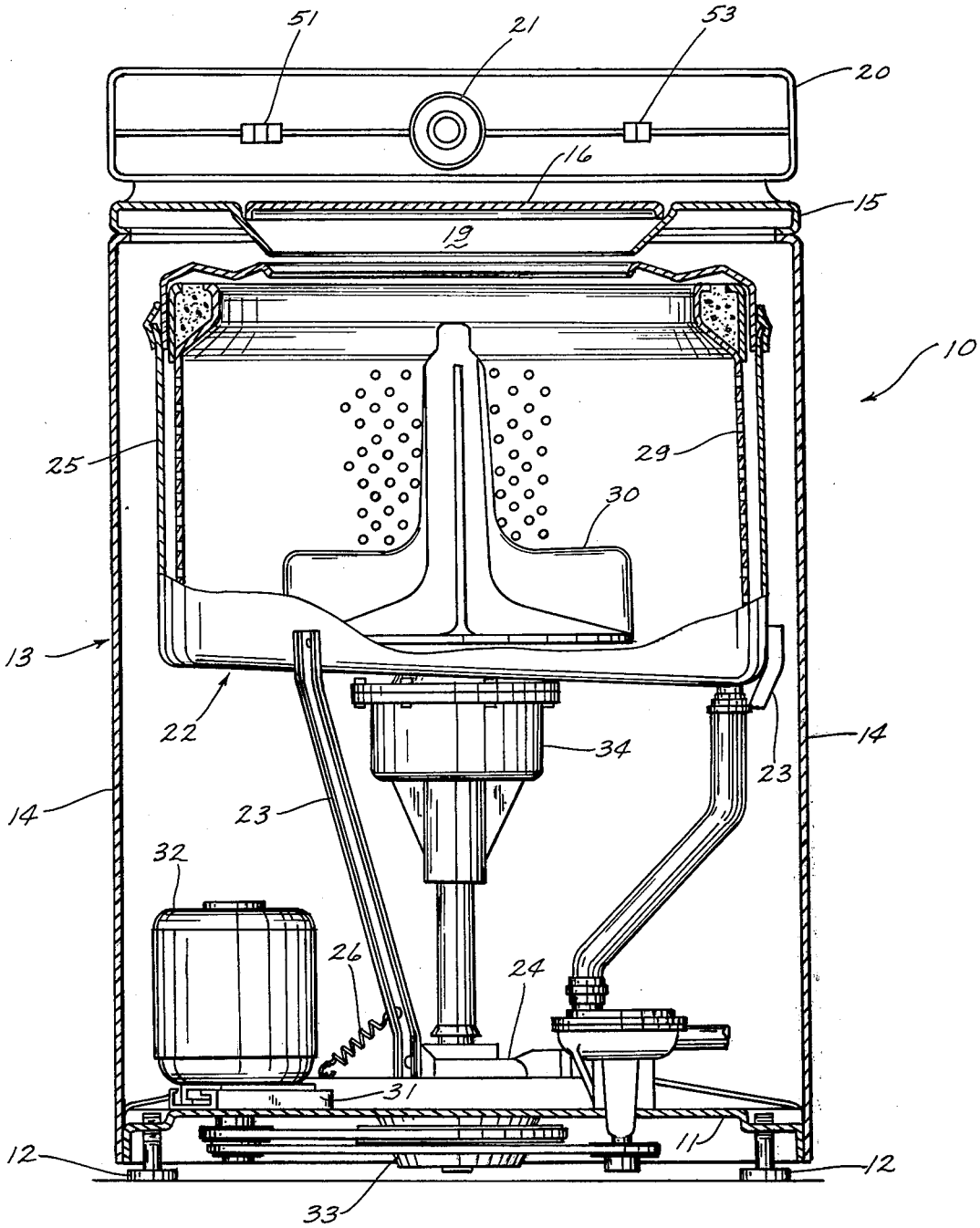
FIG. 1 is an overall view of an automatic washing machine incorporating the instant invention.

Referring now to FIG. 1, there is shown an automatic washing machine 10 including a base frame 11 supported on a plurality of adjustable legs 12 and mounting a cabinet 13 comprising sidewall portions 14 and a top cover portion 15. The top cover portion 15 includes a hinged door panel 16 normally covering a recessed loading opening 19 and further includes an upwardly extending control housing 20 for accommodating various control members such as programming means actuatable by the dial 21.

Mounted within the cabinet 13 is a tub assembly 22 nutationally supported on the base frame 11 by an inverted tripod arrangement including tub braces 23 which are connected at the lower end to a support member 24 positioned on the base frame 11. The tub braces 23 are connected at their upper ends to a generally imperforate outer liquid container or tub 25. The tub braces 23 are also resiliently connected to the base frame 11 by means of centering springs 26 which resist rotation of the support member 24 relative to the base frame 11 but permit nutational movement relative to the base frame 11.

Revolvably mounted in the imperforate outer tub 25 is a perforate clothes basket or inner tub 29 in which is positioned an oscillatable agitator 30 for effecting movement of fabrics and washing liquid within the tub assembly 22. The imperforate outer tub 25 and the perforate inner tub 29 are substantially aligned with the loading opening 19 in the top cover 15 for permitting the operator to place fabrics within the inner tub 29 and to remove them upon completion of the cycle.

The base frame 11 also supports, through a motor mount 31, a reversible drive motor 32 operable in a bidirectional drive system for selectively effecting oscillation of the agitator 30 or centrifugal rotation of the inner tub 29.

Operation of the motor 32 in a first direction effects rotation of a main drive pulley 33 for effecting oscillation of the agitator 30 through a drive shaft (not shown) and gearing of transmission 34. Operation of the motor 32 in the opposite direction effects rotation of the drive pulley 33 and the transmission 34 through a clutch (not shown) for rotating the inner tub 29 to effect centrifugal extraction of liquid from fabrics within the inner tub 29.

The washing machine 10 is provided with controls for programming the machine through a sequence of operations including energization of the motor 32 for operation in a first direction to effect a washing and/or rinsing function followed by energization of the motor 32 in a second direction to effect a liquid extraction function.

The construction and mounting of the tub assembly 22 and the operation of the inner tub 29 and agitator 30 for effecting washing and extraction operations are more clearly and specifically shown in the following patents, each of which is assigned to the assignee of the instant invention: Scott et al U.S. Pat. No. 2,854,297;

Smith et al U.S. Pat. No. 2,926,136; Burkland U.S. Pat. No. Re 25,157; and Goodlaxson U.S. Pat. No. 3,013,645.

Figures 2, 3:
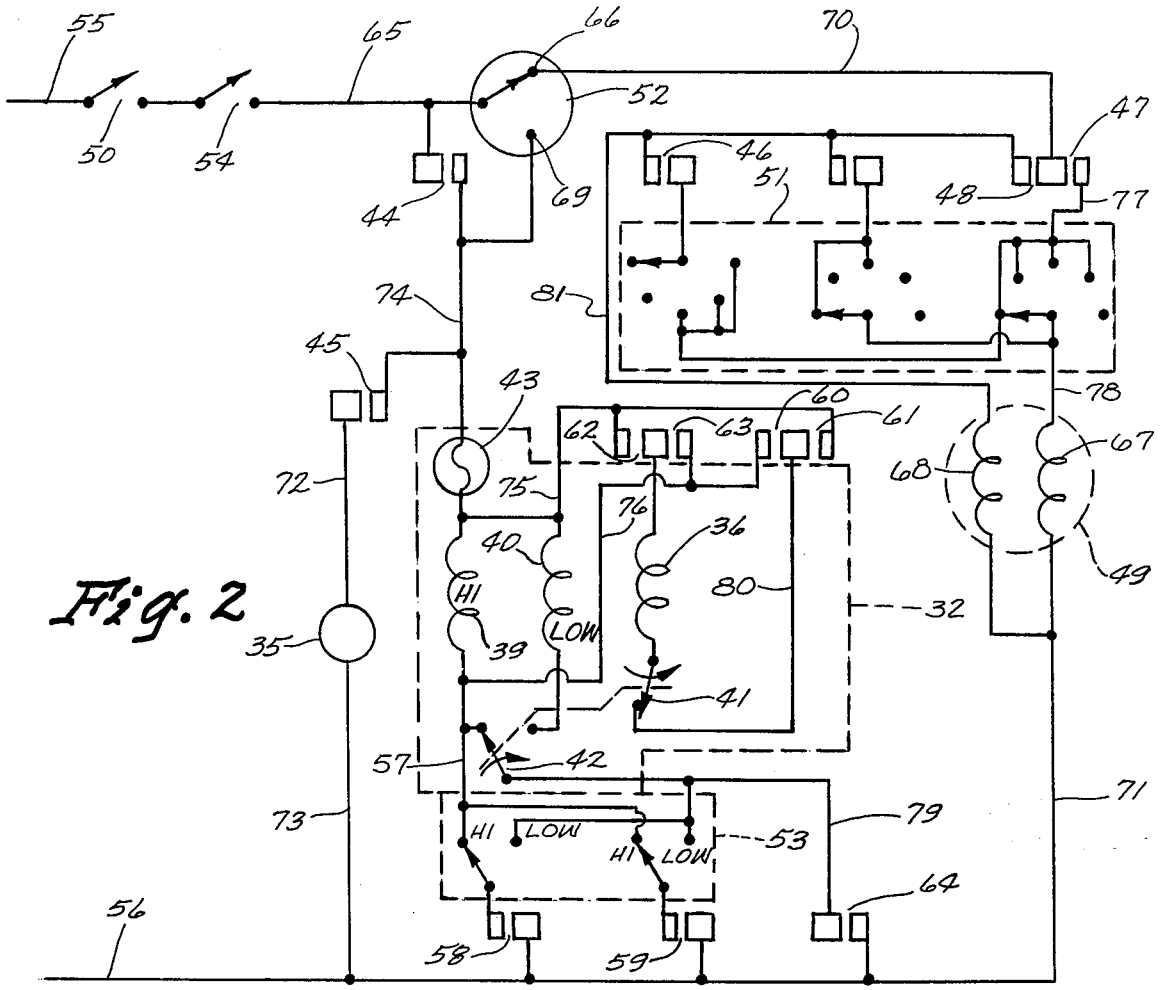
FIG. 2 is a schematic electrical circuit of the automatic washing machine including the circuitry of the instant invention.
FIG. 3 is a partial timer cam chart relating to the electrical schematic of FIG. 2 and to a permanent press wash cycle.

There is shown in FIGS. 2 and 3 an electrical schematic circuit and a timer cam chart. The circuit of FIG. 2 shows a plurality of contact pairs operable between open and closed positions by a set of cams under control of a timer motor 35. The contact pairs function as switching means and are referred to as timer switches whose opening and closing is shown by the cam chart of FIG. 3.

The circuit of FIG. 2 also includes the drive motor 32 comprising a start winding 36, high and low speed run windings 39 and 40, centrifugal switches 41 and 42, and a thermal protector 43. Timer switches 60–63, as shown in FIG. 2, control functions of the drive motor 32 but are not physically associated with the drive motor 32. The circuit of FIG. 2 further includes a combination hot and cold water inlet valve 49, a lid operated switch 50, a water temperature selection switch 51, a liquid level pressure switch 52, a drive motor speed selection switch 53 and a line switch 54. The line switch 54 is used to initiate operation of the washing machine 10 by the operator axially moving the timer dial 21 to close the line switch 54. The circuit may be connected to a conventional 110 volt, 60 Hz. power supply by the line conductors 55 and 56.

A normal "Permanent Press" washing cycle of operations of an automatic washing machine 10 as embodied herein includes, in sequence, an initial liquid filling of the machine 10; agitation to effect washing of the fabrics; removal of at least a portion of the washing liquid by spinning and pumping out; a refilling of the machine 10 with rinse liquid; agitation to effect rinsing of the fabrics; removal of the rinse liquid from the machine 10; a refilling of the machine 10 with rinse liquid; and a final removal of liquid from the machine 10.

As shown schematically in FIG. 2, the operator has the opportunity to choose, in addition to cycle selection through rotary movement of the timer dial 21, the desired water temperatures for wash and rinse and the operating speeds for agitate and spin. These selections are made through manipulation of the water temperature and speed selection switches 51 and 53 mounted in the control housing 20.

The "Permanent Press" cycle of operations is selected by rotating the timer dial 21 to the cycle start position which in this case would be interval 3 of the timer cam chart. With the selection of the "Permanent Press" cycle, and the timer mechanism positioned at interval 3, timer switches 45, 46, 47, 58, 60, and 62 will be initially closed. Upon the operator closing the line switch 54, as by axially moving the timer dial 21, and assuming that the lid switch 50 has been closed by closing the lid or access door 16, the machine 10 will be energized for initiating the "Permanent Press" cycle of operations.

In interval 3 of the cam chart a circuit is completed through line conductor 55, the lid switch 50, the line switch 54, conductor 65, the pressure switch 52 made to the "empty" contact 66, through conductor 70, closed timer switch 47, conductor 77, selector switch 51, and conductor 78 to the hot coil 67 of the water valve 49. The other side of the water valve 49 is connected to line conductor 56 through conductor 71. The water valve 49 will operate until the pressure switch 52 operates from the "empty" contact 66 to the "full" contact 69. When the pressure switch 52 moves to the "full" contact 69 a circuit is completed to the timer motor 35 through timer switch 45, and conductors 72 and 74 for energizing the timer motor 35. The other side of the timer motor 35 is connected to line 56 by conductor 73.

The drive motor 32 will be energized to initiate agitation of the liquid and the fabrics within the tub 29. The drive motor circuit extends from line conductor 55, through the lid switch 50, the line switch 54, the pressure switch 52 made to the "full" contact 69, and through conductor 74 to one side of the drive motor 32. The circuit will continue through the thermal protector 43, conductor 75, timer switch 62, start winding 36, closed centrifugal switch 41, conductor 80, timer switch 60, conductor 76, conductor 57, speed selection switch 53 made to the high speed contact, and closed timer agitation switch 58 to conductor 56. The high speed run winding 39 is also energized through the circuit comprising: conductor 57, the switch 53, and timer agitation switch 58 to line 56. As the drive motor 32 attains operating speed the centrifugal switch 41 will open and centrifugal switch 42 will be made to the low speed run winding 40. The drive motor 32 will operate on either the high or low speed run winding 39 or 40 depending upon the selection made by the operator through speed selection switch 53. The posture of the speed selection switch 53 as depicted in FIG. 2 indicates high speed agitation and spin speed selections made by the operator.

At the end of interval 9 on the timer cam chart, agitation will cease with the opening of timer agitation switch 58. The cam stack will continue to be rotated since timer switch 45 remains closed for energizing the timer motor 35. Beginning at interval 10, timer switches 48, 61, 63, and 64 will be closed in addition to timer switch 45. The drive motor start winding 36 will now be energized through timer switches 61 and 63 to reverse the direction of rotation for the initial spin and pump out operation.

As previously mentioned, when the start winding 36 drops out of the circuit by the opening of the centrifugal switch 41, the centrifugal switch 42 is brought into series connection with the low speed run winding 40 of the drive motor 32. The timer switch 64 is also closed during this initial spin increment at interval 10 and is connected in series with the centrifugal switch 42 through conductor 79. This arrangement provides a bypass series circuit in parallel connection to the speed selection switch 53 to insure that the drive motor 32 can only operate in the low speed run winding 40 for this interval of time thus overriding the speed selection made by the operator. Timer switches 58 and 59 are open during this interval for preventing a circuit from being made through the speed selection switch 53.

In interval 10 the drive motor 32 and the timer motor 35 will both be interrupted when the liquid level in the tub 25 is pumped low enough to reset the pressure switch 52 to the "empty" contact 66. The cold side 68 of the water valve 49 will then be energized through a circuit extending from the "empty" contact 66, through conductor 70, closed timer switch 48, and conductor 81 to the cold coil 68 to refill the tub 25 with cold liquid for cooling the fabrics. The drive motor 32 will be reenergized in the low speed spin mode to the end of the interval 10 after refilling with cold liquid. If reenergization of the drive motor 32 in the spin mode for the remainder of interval 10 results in the pressure switch 52 being reset to the "empty" contact 66, the water valve 49 will again be actuated to refill the tub 25 prior to agitation in interval 12. The low speed initial spin and subsequent fill with cold liquid reduces the potential for wrinkling of the fabrics within the clothes basket or inner tub 29.

The machine 10 will operate for an interval of agitation at interval 12. Following the interval of agitation, the machine 10 will be reversed for spin and pump out and will then be refilled with cold liquid for another interval of agitation. The "Permanent Press" cycle will end after a final three intervals of spin and pump out. Following the initial spin and pump out in interval 10, all of the agitate and spin segments of the cycle will be at the drive motor 32 operating speeds selected by the operator.

It is thus seen that the described control includes an improved "Permanent Press" washing cycle permitting both cycle selection and drive motor 32 speed selection by the operator. In the first interval of spin and pump out, series circuit means comprising the drive motor centrifugal switch 42 and the timer switch 64 are utilized in a series circuit portion in parallel circuit connection with the speed selection switch 53 and timer switches 58 and 59 to bypass or override the operating speed selection made by the operator. An assured slow speed spin is thus provided in at least the first spin interval regardless of the speed selection made by the operator.

In the drawings and specification there is set forth a preferred embodiment of the invention and though specific terms are employed these are used in a generic and descriptive sense only and not for purposes of limitation. Changes in form and the proportion of parts as well as the substitution of equivalents are contemplated as circumstances may suggest or render expedient without departing from the spirit or scope of this invention as defined in the following claims.

I Claim:

1. A control system for a fabric washing apparatus operable through a plurality of cycles and including an agitator within a rotatable fabric-receiving basket and drive means selectively operable for driving each of said agitator and basket at a first relatively low speed and a second relatively high speed, the combination comprising: sequential control means for controlling said apparatus through a predetermined sequence of events defining said plurality of cycles; cycle selection means for selecting a particular one of said plurality of cycles; speed selection means operable independently of said cycle selection means and including switch means for effecting one of the speeds of said drive means; and circuit means associated with said sequential control means and said drive means and actuated during a predetermined portion of said particular one cycle to provide a bypass circuit relative to said switch means for overriding said speed selection means and operating said drive means in the other of said speeds during the predetermined portion of said particular one cycle and permitting operation at the selected speed for the balance of the cycle.

2. A control system as defined in claim 1 wherein said circuit means includes bypass means forming a series circuit connection for completing said bypass circuit in parallel connection to said speed selection means.

3. A control system for a fabric washing apparatus operable through a plurality of cycles and including an agitator within a rotatable fabric-receiving basket and drive means selectively operable for driving each of said agitator and basket at a first relatively low speed and a second relatively high speed, the combination comprising: sequential control means for controlling said apparatus through a predetermined sequence of events defining said plurality of cycles; cycle selection means for selecting a particular one of said plurality of cycles; speed selection means operable independently of said cycle selection means and including first switch means for effecting one of the speeds of said drive means; and circuit means associated with said sequential control means and said drive means including second switch means actuated during a predetermined portion of said particular one cycle and further including third switch means centrifugally actuated responsive to operation of said drive means, said second and third switch means providing a bypass circuit relative to said first switch means for overriding said speed selection means and operating said drive means in the other of said speeds during the predetermined portion of said particular one cycle and permitting operation at the selected speed for the balance of the cycle.

4. A control system as defined in claim 3 wherein said circuit means including said second and third switch means form a series circuit connection for completing said bypass circuit in parallel connection to said first switch means.

5. A control system for a fabric washing apparatus operable through a plurality of cycles for washing regular or permanent press fabrics and including an agitator within a rotatable fabric-receiving basket and drive means selectively operable for driving each of said agitator and basket at a first relatively low speed and a second relatively high speed, the combination comprising: sequential control means for controlling said apparatus through a predetermined sequence of events defining said plurality of cycles; cycle selection means for selecting a permanent press cycle of operations; speed selection means operable independently of said cycle selection means and including first switch means for effecting one of the speeds of said drive means; and circuit means associated with said sequential control means and said drive means including second switch means actuated during a predetermined portion of said permanent press cycle and further including third switch means centrifugally actuated responsive to operation of said drive means, said second and third switch means providing a series bypass circuit in parallel circuit connection to said first switch means for overriding said speed selection means and operating said drive means in the other of said speeds during the predetermined portion of said permanent press cycle and permitting operation at the selected speed for the balance of the cycle.

6. A control system for a fabric washing apparatus operable through a plurality of cycles for washing regular or permanent press fabrics and including an agitator within a rotatable fabric-receiving basket, washing liquid inlet means and drive means selectively operable for driving each of said agitator and basket at a first relatively low speed and a second relatively high speed, the combination comprising: sequential control means for controlling said apparatus through a predetermined sequence of events defining said plurality of cycles; cycle selection means for selecting a permanent press cycle of operations; speed selection means operable independently of said cycle selection means and including a first switch for effecting high speed operation of said drive means; and circuit means associated with said sequential control means and said drive means including a second switch operable to a closed posture during an initial cool-down spin of said permanent press cycle and further including a third switch centrifugally movable to a closed posture responsive to operation of said drive means, said second and third switches being in a series connection for completing a bypass circuit in parallel to said first switch for effecting low speed operation of said drive means whereby low speed operation of said drive means is assured for a predetermined increment of time during the initial cool-down spin operation of said permanent press cycle for reducing the volume of liquid pumped from said apparatus to allow said fabrics to cool down with reduced wrinkling and whereby said drive means will operate at the selected speed for the balance of the cycle.

* * * * *